US007367143B2

(12) United States Patent
Stoetzer

(10) Patent No.: US 7,367,143 B2
(45) Date of Patent: May 6, 2008

(54) CUTTER AND METHOD FOR WORKING THE SOIL

(75) Inventor: Erwin Stoetzer, Aichach (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 161 days.

(21) Appl. No.: 11/200,082

(22) Filed: Aug. 10, 2005

(65) Prior Publication Data

US 2006/0032096 A1 Feb. 16, 2006

(30) Foreign Application Priority Data

Aug. 12, 2004 (EP) ..... 04019188

(51) Int. Cl.
*E02F 3/24* (2006.01)

(52) U.S. Cl. ..... 37/189; 37/462; 37/195; 175/91

(58) Field of Classification Search ..... 37/189, 37/365, 195, 462; 175/91
See application file for complete search history.

(56) References Cited

U.S. PATENT DOCUMENTS

| | | | | | |
|---|---|---|---|---|---|
| 2,884,721 | A | * | 5/1959 | Pool | 37/300 |
| 4,189,386 | A | * | 2/1980 | Aman | 210/235 |
| 4,202,416 | A | * | 5/1980 | Blaschke et al. | 175/94 |
| 4,373,278 | A | * | 2/1983 | Myrick | 37/340 |
| 4,629,010 | A | * | 12/1986 | Sourice | 175/57 |
| 4,694,915 | A | * | 9/1987 | Bauer et al. | 175/91 |
| 4,770,255 | A | * | 9/1988 | Barthelemy et al. | 175/6 |
| 4,957,175 | A | * | 9/1990 | Lipsker et al. | 175/94 |
| 5,056,242 | A | * | 10/1991 | Miotti | 37/94 |
| 5,234,257 | A | * | 8/1993 | Sugden et al. | 299/10 |
| 5,398,430 | A | * | 3/1995 | Scott et al. | 37/142.5 |
| 5,707,182 | A | * | 1/1998 | Leffer | 405/267 |
| 5,836,089 | A | * | 11/1998 | Lipsker | 37/186 |
| 5,931,235 | A | | 8/1999 | Weixler | |
| 6,076,290 | A | * | 6/2000 | Seitle et al. | 37/398 |
| 6,446,364 | B1 | * | 9/2002 | Herrero Codina | 37/187 |
| 6,839,989 | B2 | * | 1/2005 | Gessay et al. | 37/189 |

FOREIGN PATENT DOCUMENTS

| | | | |
|---|---|---|---|
| CN | 2557501 | Y | 6/2003 |
| DE | 1 634 262 | | 9/1970 |
| DE | 39 05 463 | A1 | 8/1990 |
| DE | 198 38 513 | A1 | 4/1999 |
| EP | 0 496 926 | A1 | 8/1992 |
| JP | 62-45831 | | 2/1987 |
| JP | 6-128960 | A1 | 5/1994 |
| JP | 6-346451 | A | 12/1994 |
| JP | 10-096247 | A | 4/1998 |
| JP | 10195924 | * | 7/1998 |

* cited by examiner

*Primary Examiner*—Thomas B Will
*Assistant Examiner*—Mai T Nguyen
(74) *Attorney, Agent, or Firm*—Jacobson Holman PLLC

(57) ABSTRACT

A cutter for working the soil includes a cutting frame, at least two cutting wheels that are supported on the cutting frame in a rotatably drivable manner about parallel axes of rotation, and an adjusting device, The adjusting device functions to adjust the center distance between the parallel axes of rotation of the cutting wheels, and includes a knee-lever mechanism. A method for working the soil is also disclosed.

9 Claims, 7 Drawing Sheets

Figure 4:
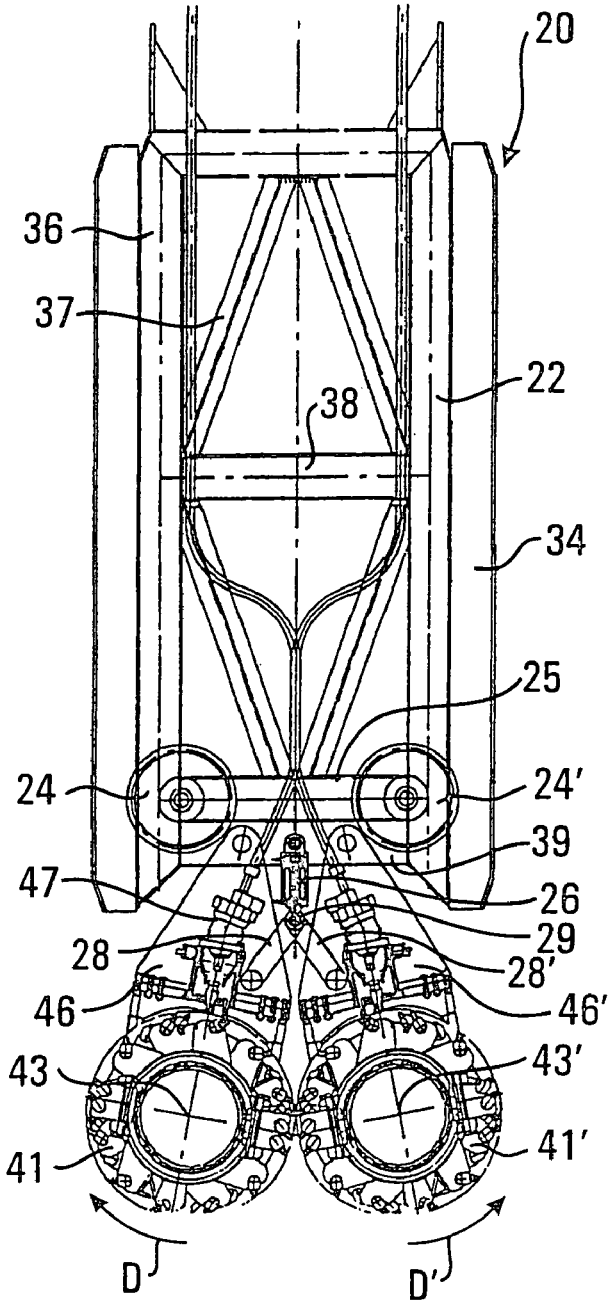

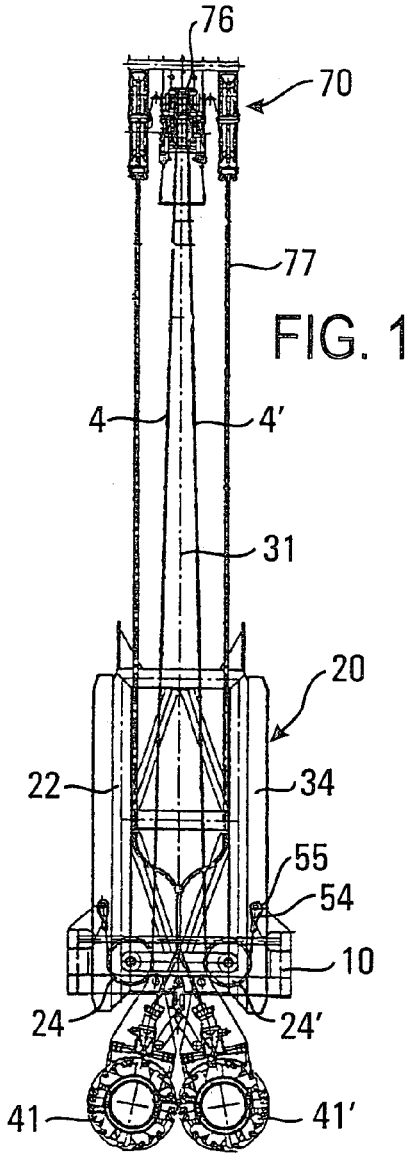
FIG. 1
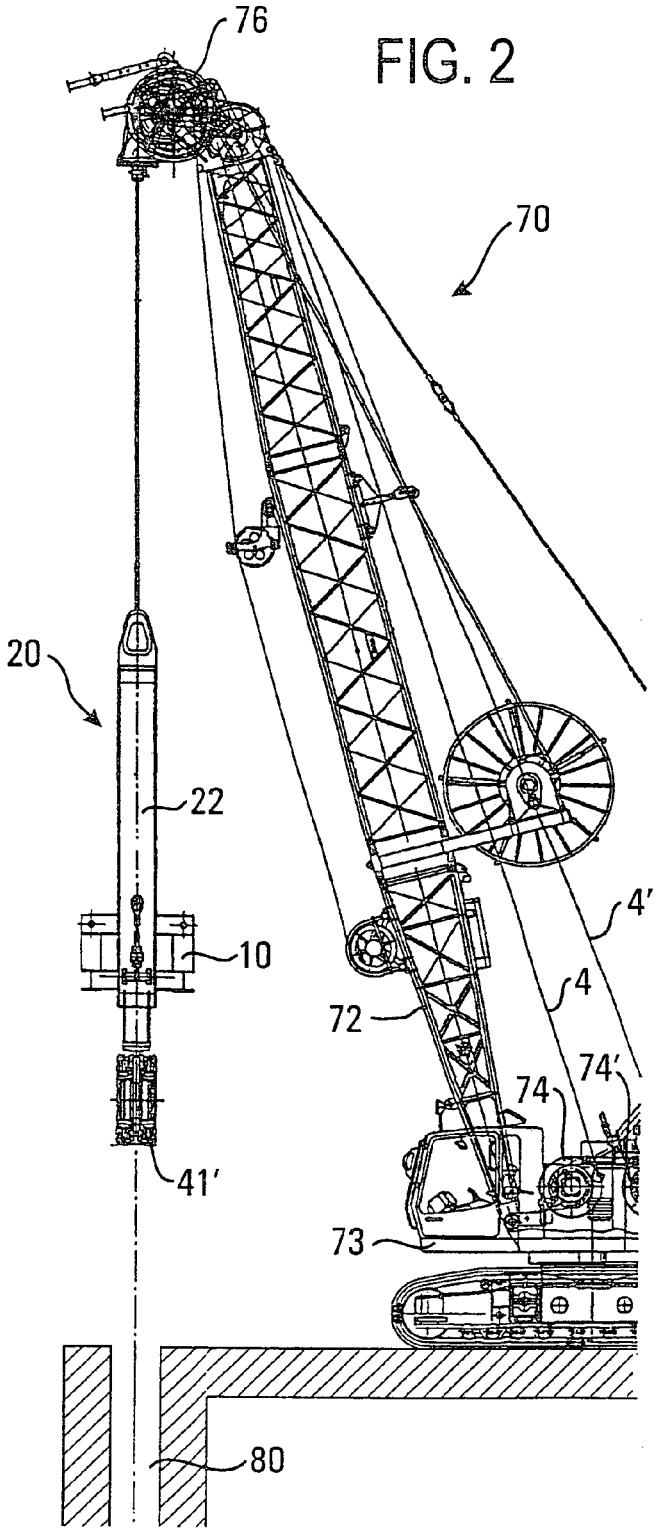
FIG. 2
FIG. 3
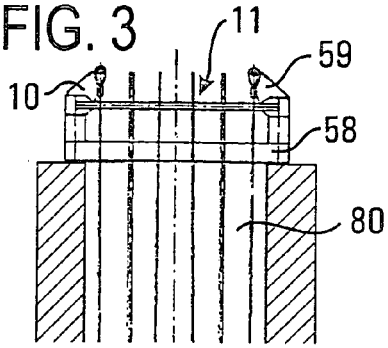

CUTTER AND METHOD FOR WORKING THE SOIL

The invention relates to a cutter for working the soil, in particular a milling cutter comprising a cutting frame, at least two cutting wheels which are supported on the cutting frame in a rotatably drivable manner about parallel axes of rotation and an adjusting device, by means of which the centre distance between the parallel axes of rotation of the cutting wheels can be adjusted. The invention further relates to a method for working the soil.

Such a cutter is known from JP 62045831 A. To pivot the cutting wheels this known cutter has two two-armed levers that are pivotally supported on the cutting frame. The cutting wheels are arranged at the lower lever arm of the two levers. At the upper lever arm of the two levers a separate hydraulic cylinder is each provided so as to operate these levers.

EP 0 496 926 A1 discloses a cutter for working the soil whose cutting wheels can be pivoted about two different axes. To change the centre distance between the cutting wheels these are arranged on two separate one-armed levers which are in turn hinged to the cutting frame. By means of two hydraulic cylinders each the two one-armed levers can be pivoted.

A further cutter with adjustable centre distance of the cutting wheels can be taken from DE-PS 1 634 262.

In DE 39 05 463 A1 a method for making trench walls by means of a trench wall cutter is described. In this known method single trench wall segments separated from each other by a soil portion are produced initially. In a second step the soil portion is cut off with the trench wall cutter. On reaching the final depth desired the cutting wheels of the trench wall cutter are extended to a broadened position. During the drawing of the trench wall cutter the lateral portions of the adjoining trench wall segments are then being worked on.

The object of the invention is to provide a particularly reliable and economical soil cutter with adjustable centre distance as well as a particularly reliable and economical soil working method with a cutter of such kind.

This object is solved by a cutter having the features of claim 1 and by a method for working the soil having the features of claim 11. Preferred embodiments are stated in the dependent claims.

The cutter according to the invention is characterized in that the adjusting device has a knee-lever mechanism and at least one hydraulic cylinder for operating the knee-lever mechanism, the hydraulic cylinder being arranged on the cutting frame approximately in the centre with respect to the two axes of rotation.

A fundamental idea of the invention can be seen in the fact that a knee-lever mechanism or toggle lever mechanism is provided for the mutual displacement of the parallel axes of rotation of the cutting wheels. Such a knee-lever mechanism has two one-armed levers which are connected with each other on one of their ends by a common hinge that can also be referred to as the knee. On the other end the two levers are each hinged to a cutting wheel bearing of one of the two cutting wheels. By means of the hydraulic cylinder, which is hinged on one side to the cutting frame and on the other side to the knee, the knee can be displaced with respect to the cutting frame and in doing so this displacement leads to a displacement of the two lever ends that are spaced from the knee and consequently to a mutual displacement of the two cutting wheel bearings. Hence, through the knee-lever mechanism it is possible to adjust both cutting wheels simultaneously by means of one single hydraulic cylinder.

As a result, the number of required driving devices can be reduced and a particularly economical and reliable cutter can be made available thereby. Through the knee-lever mechanism located on the hydraulic cylinder a particularly uniform distribution of force is present so that the reliability of the cutter is increased further.

In accordance with the invention it is particularly preferred that the two levers of the knee-lever mechanism have the same lever length. It can be ensured thereby that during the operation of the adjusting device the two cutting wheels are adjusted in the same way in a particularly reliable manner. An embodiment that proves to be particularly advantageous with regard to the carrying of force is provided in that the hinge axis of the knee and the axes of the hinges arranged between the two cutting wheel bearings and the two levers extend parallel to each other and/or parallel to the axes of rotation of the cutting wheels. Within the meaning of the invention parallelism can be understood in particular in that two axes enclose an angle of less than 5°, in particular less than 2° or 1°. Advantageously, the axes of rotation of the cutting wheels maintain their parallelism during the adjustment of their centre distance.

An embodiment of the cutter according to the invention that is particularly simple from a constructional point of view is characterized in that the two cutting wheels are supported on a respective bearing shield, that the two bearing shields are pivotally supported on the cutting frame and that the knee-lever mechanism has two levers which are hinged on one side to a central hydraulic cylinder and on the other side to one of the two bearing shields respectively. Hence, according to this embodiment a single hydraulic cylinder is provided for operating the knee-lever mechanism. The hydraulic cylinder suitably extends in the vertical direction of the cutter, i.e. in its advance direction. It is advantageous for the pivot axes of the two bearing shields or bearing brackets to be arranged parallel to each other and parallel to the axes of rotation of the cutting wheels. The pivot axes may coincide with each other or be spaced from each other. Apart from a pivotal bearing of the two bearing shields on the cutting frame a displaceable bearing may also be provided that can include a bearing rail for example.

Furthermore, a particularly advantageous embodiment of the invention resides in the fact that the cutting frame has guide members for guidance in a trench in the soil. The trench can be made both by the cutter itself and by another trench wall device such as e.g. a trench wall grab. Such guide members are of particular advantage if an existing trench is intended to be overcut by means of the cutter, i.e. its side walls are to be broadened and/or profiled, and in particular when doing so adjoining trench wall panels are to be cut into. Since the cutter may serve to work on the intermediate space between the trench and an adjoining trench wall panel, it can also be referred to as milling cutter. The guide members according to the invention ensure a lateral guidance of the cutter in the existing trench so that the position of the cutting cross section of the cutting wheels in relation to the existing trench is determined in a particularly good manner whereby a particularly precise overcutting of the trench is rendered possible.

It is suitable for the guide members to be designed as guide plates that extend externally on the cutting frame in the vertical direction. However, the guide members can also be designed in a latticed manner, in which case the individual grid struts may serve as guidance. If the cutting frame is designed with an approximately rectangular cross section, it is suitable for the guide members to be arranged on the cutting frame at least on the front face.

Another preferred embodiment of the cutter according to the invention is characterized in that the cutting wheels can be adjusted by means of the adjusting device in such a way that in a retracted state they are set backwards with respect to the guide members and in an extended state they protrude laterally with respect to the guide members. According to this embodiment the cutter can be lowered into the trench and/or lifted therefrom without a substantial cutting action being carried out on the walls of the trench when the cutting wheels are in the retracted state. To work on the walls of the trench the cutting wheels can be extended, so that in relation to a cross section of the cutting frame they protrude into the walls of the trench. It is of advantage for the cutting wheels, whilst being in the extended state, to protrude from the front face of the cutting frame, with the front faces being suitably arranged in parallel to the axes of rotation of the cutting wheels.

In accordance with the invention it is particularly advantageous that the bearing shields comprise a V-arrangement in the retracted state and the extended state, and in the retracted state the pivotal axes of the bearing shields at the cutting frame have a distance to each other being smaller than the distance between the axes of rotation of the cutting wheels. The center axes of the bearing shields crossing the respective pivotal axis and axis of rotation form an angle of the V-arrangement. This angle preferably ranges between 3° and 50° in the retracted state. This V-arrangement of the bearing shields facilitates an efficient movement of the bearing shields outwards.

The cutting width of the cutting wheels is smaller than the width of the cutting frame. Here the cutting width and the width of the cutting frame are understood as the external dimensions as measured in the direction of the axes of rotation of the cutting wheels. According to this embodiment the cutting wheels do not work on the walls of the trench across their entire width, i.e. the walls and in particular the adjoining trench wall panel are being profiled. Alternatively or additionally the cutting wheels can have a profiled circumferential surface for the profiling of the walls.

For the lowering and drawing of the cutter a supporting cable can be provided, on the end of which the cutter can generally be fixed. As an alternative or in addition it is possible according to the invention that at least one guide pulley is provided in particular on the cutting frame for suspension into the supporting cable. Hence, in accordance with this embodiment the cutter is reeved in a double-stranded manner into the supporting cable, whereby the tensile force in the supporting cable can at least be approximately halved. This embodiment proves to be of particular advantage if the cutting is carried out during the drawing of the cutter, especially if the cutting wheels are retracted during the lowering of the cutter and extended during the drawing of the cutter. In this case the supporting cable has to carry the feeding forces required for the feeding of the cutting wheels in the soil in addition to the weight force of the cutter when the latter is being drawn.

In accordance with the invention a particularly precise control of the upward and downward movement of the cutter in the soil and thus a particularly good cutting result can be achieved in that a feeding device is provided through which the guide pulley can be displaced with respect to the cutting frame in the advance direction of the cutter, the feeding device including in particular a hydraulic feed cylinder arranged centrally on the cutting frame. This feeding device makes it possible to change the vertical position of the guide pulley with respect to the cutter, i.e. the vertical position of the cutter with respect to the supporting cable and consequently the depth position of the cutter even when the supporting cable is stationary. The hydraulic cylinder of the feeding device permits a particularly precise displacement of the guide pulley on the cutting frame in a particularly simple manner.

A further advantageous embodiment of the cutter according to the invention is characterized in that a support device is provided on which the supporting cable is suspended, that a retaining frame is provided in addition to the support device, and that the supporting cable is connected to the retaining frame such that at least during the drawing of the cutter a part of the tensile force is directed via the retaining frame into the soil. Hence, according to this embodiment only a part of the tensile force of the cutter is carried via the supporting cable by the support device, which may be a crane for example. Another part of the tensile force is passed on via the supporting cable to the retaining frame and is led from there into the soil.

It is of particular advantage for the cutting wheels to be designed as cutting wheel pairs having two single cutting wheels each that are arranged in particular on both sides of the respective bearing shield. For the purpose of suitability the two single cutting wheels have aligned axes of rotation and/or a common drive respectively. The drives of the cutting wheels are suitably arranged on the bearing shields.

A cutter that is particularly suitable to carry the forces occurring during the cutting operation is characterized in that the cutting frame, the cutting wheels and/or the knee-lever mechanism are designed in a mirror-symmetrical manner. By preference, the plane of symmetry extends parallel to the axes of rotation of the cutting wheels.

Another central idea of the invention can be seen in a method for working the soil, in which a cutter comprising a cutting frame and at least two cutting wheels that are rotatably supported on the cutting frame about parallel axes of rotation is introduced into a trench in the soil, in which the centre distance between the parallel axes of rotation is enlarged by means of a knee-lever mechanism such that the two cutting wheels protrude laterally from the cutting frame, and in which the cutting wheels are set into rotation and the cutter is drawn whilst material is being stripped on the walls of the trench. The method according to the invention can be carried out in particular with a cutter according to the invention, whereby the advantages described in this connection can be achieved.

A fundamental idea of the method in accordance with the invention can be seen in the fact that the walls of the trench located in the soil are not worked on during the lowering of the cutter into the trench but only during the drawing of the cutter from the trench. Contrary to a cutting operation taking place during the lowering of the cutter, the weight of the cutter proper does not contribute to the drive force of the cutting wheels during the drawing carried out in a cutting operation according to the invention. The cutter can therefore be designed in a particularly light and economical manner according to the invention.

In order to achieve a cutting effect on the walls singularly during the drawing of the cutter provision is made for the cutting wheels to be adjusted by means of a knee-lever mechanism such that the cutting wheels lie within the cross section of the trench during the lowering of the cutter and protrude into the walls of the trench during the drawing of the cutter. In this the knee-lever mechanism ensures in a particularly simple and reliable manner that both cutting wheels are adjusted simultaneously by the same angular amount so that a blocking of the cutter in the trench can be prevented to a large degree.

The trench, whose walls are worked with the cutter, can be made by the cutter itself but preferably by another trench wall device such as e.g. a trench wall grab. If the trench already exists when the cutter is being introduced, it is overcut, i.e. recut by means of the cutter. During the working with the cutter the walls of the trench are suitably profiled, i.e. they are cut into at different depths along their width. During the cutting of the walls of the trench it is suitable to cut into adjoining trench wall panels that have hardened already so that particularly high-quality and fluid-tight connecting joints and thus trench walls with a particularly high tightness can be produced according to the invention.

Basically, it is possible to suck off and/or pump out the soil material stripped by the cutting wheels from the walls during the cutting operation. However, it is especially preferred that the soil material is conveyed to the bottom of the trench as a result of the effect of gravity. Since the cutting is being carried out during the drawing in accordance with the invention, the stripped soil material that has accumulated at the bottom of the trench does not obstruct the cutting operation. In particular, the trench can therefore be overcut in one single step. After the drawing of the cutter from the trench the soil material accumulated at the bottom of the trench can be conveyed therefrom with a grab.

In principle, the direction of rotation of the two cutting wheels can be chosen as desired. However, it is particularly preferred that the two cutting wheels are driven in a counter-rotating manner.

The invention is described in greater detail hereinafter relative to preferred embodiments and the attached drawings, wherein schematically show:

FIG. 1 A front view of a soil working apparatus with a soil working device constructed as a cutter and with the latter raised in accordance with a first embodiment.

FIG. 2 A side view of the apparatus of FIG. 1.

FIG. 3 A holding frame of the apparatus of FIG. 1 with the cutter lowered, in front view.

FIG. 4 A front view of the cutter of the apparatus of FIG. 1.

Figure 5:
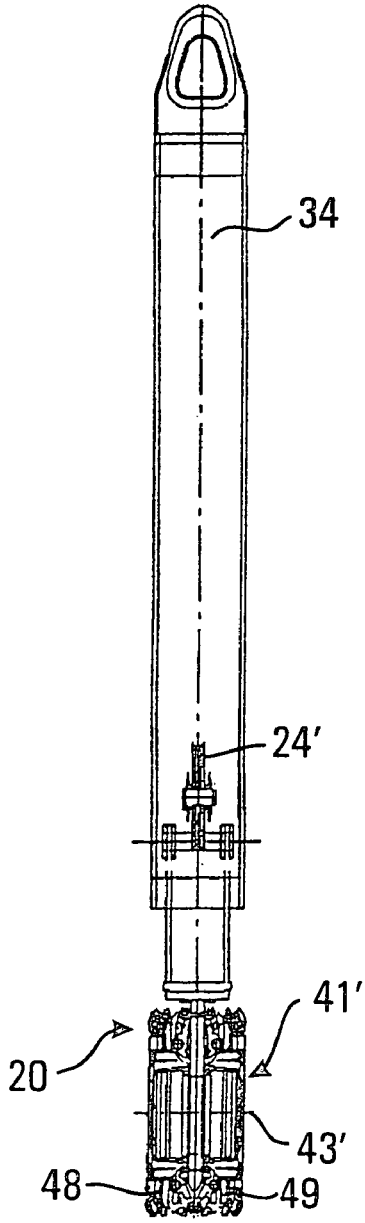

FIG. 5 A side view of the cutter of the apparatus of FIG. 1.

Figure 6:
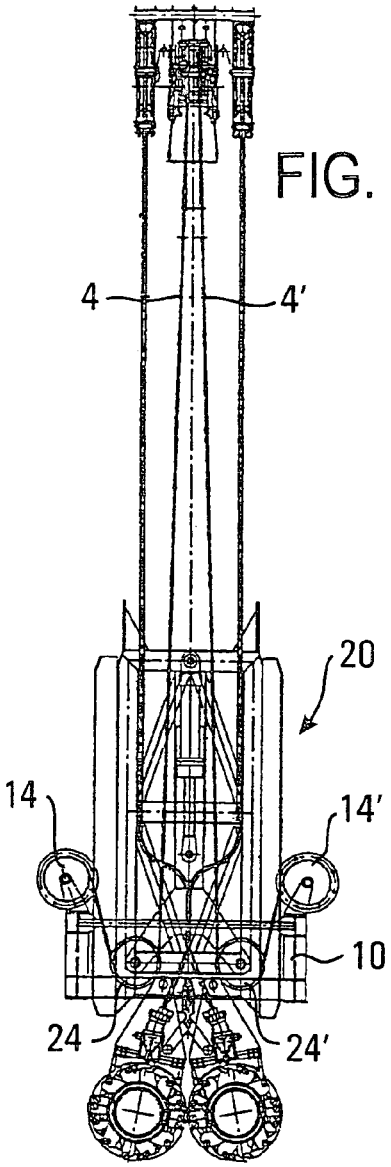

FIG. 6 A front view of a soil working apparatus with a soil working device constructed as a cutter and with the cutter raised, according to a second embodiment.

Figure 7:
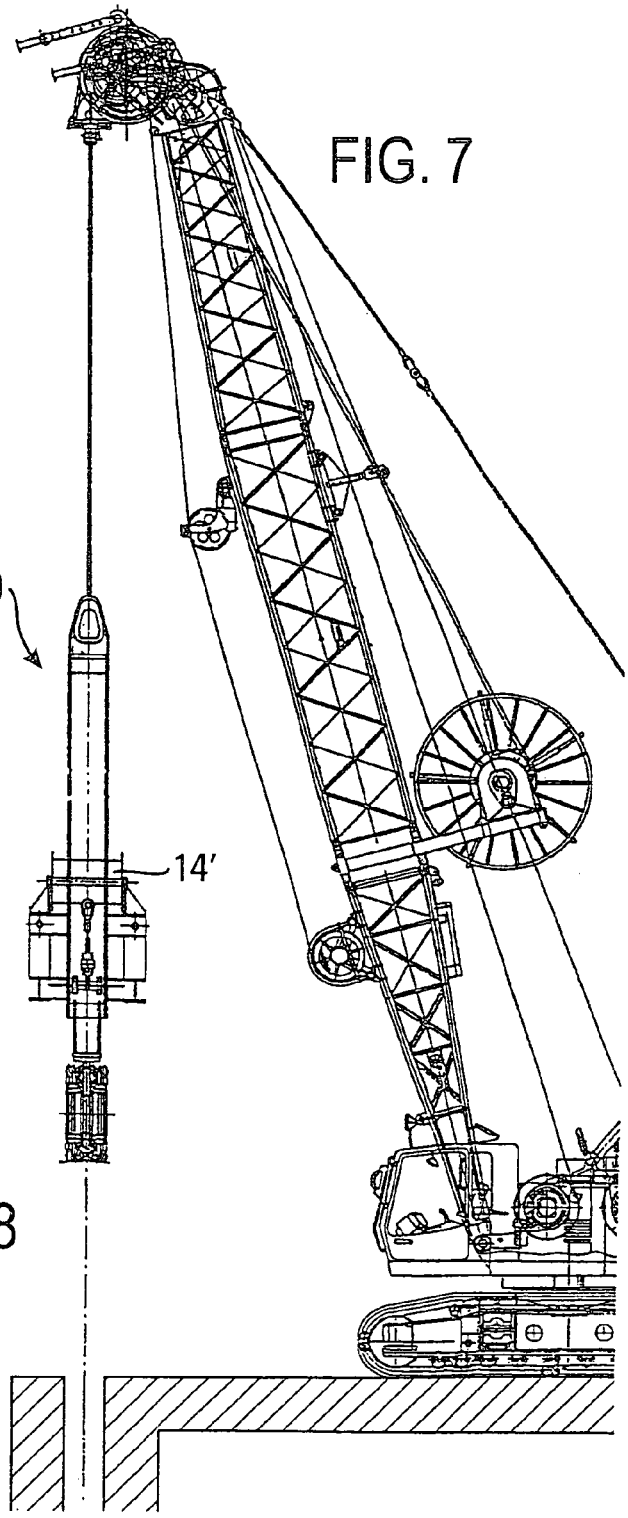

FIG. 7 A side view of the apparatus of FIG. 6.

Figure 8:
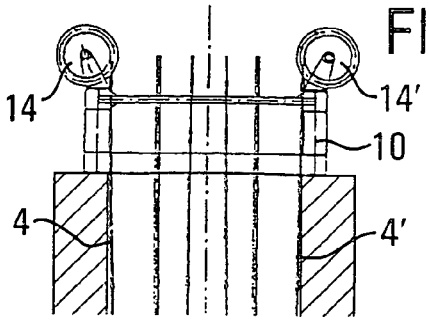

FIG. 8 A front view of a holding frame of the apparatus of FIG. 6, with the cutter lowered.

Figure 9:
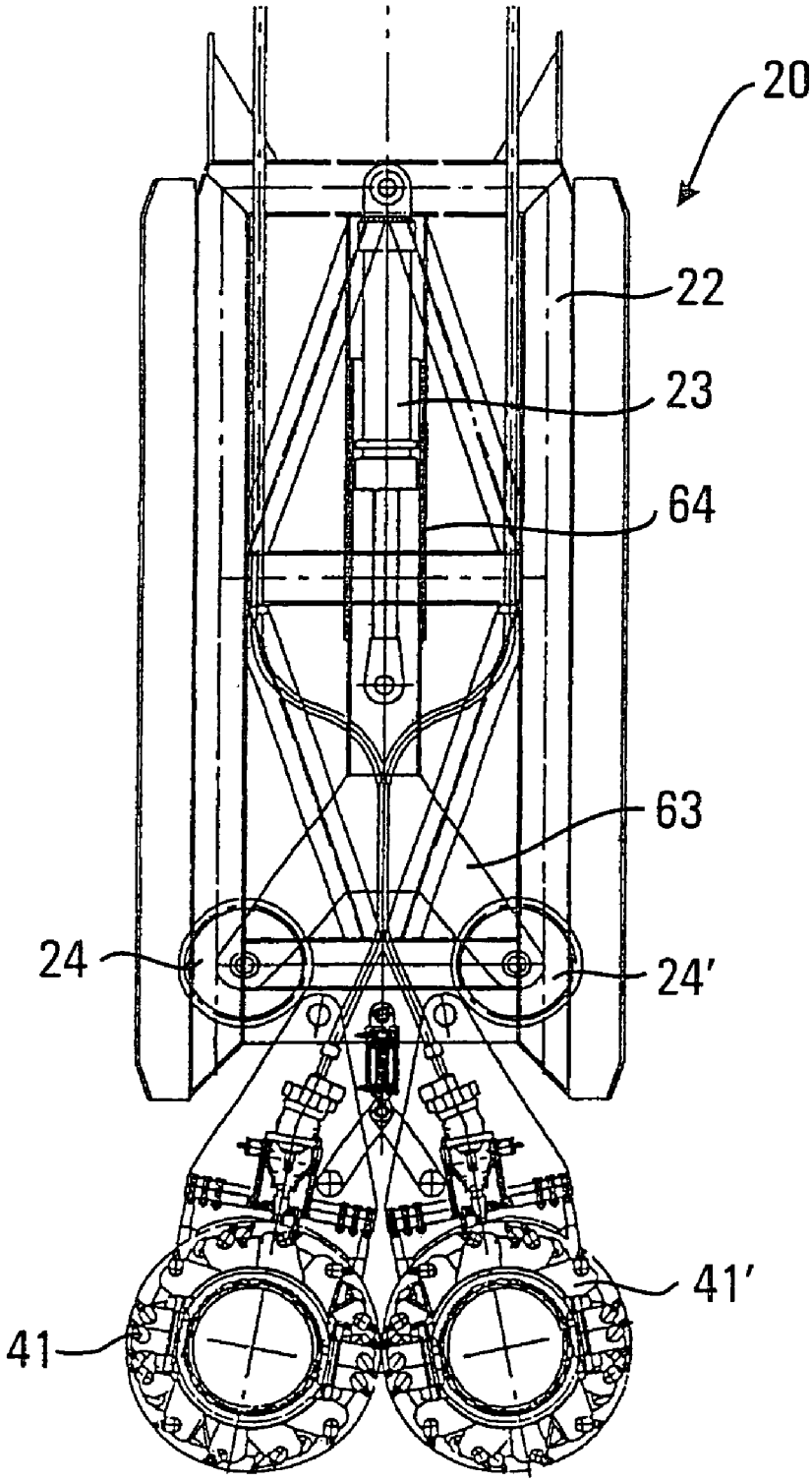

FIG. 9 A front view of the cutter of FIG. 6.

Figure 10:
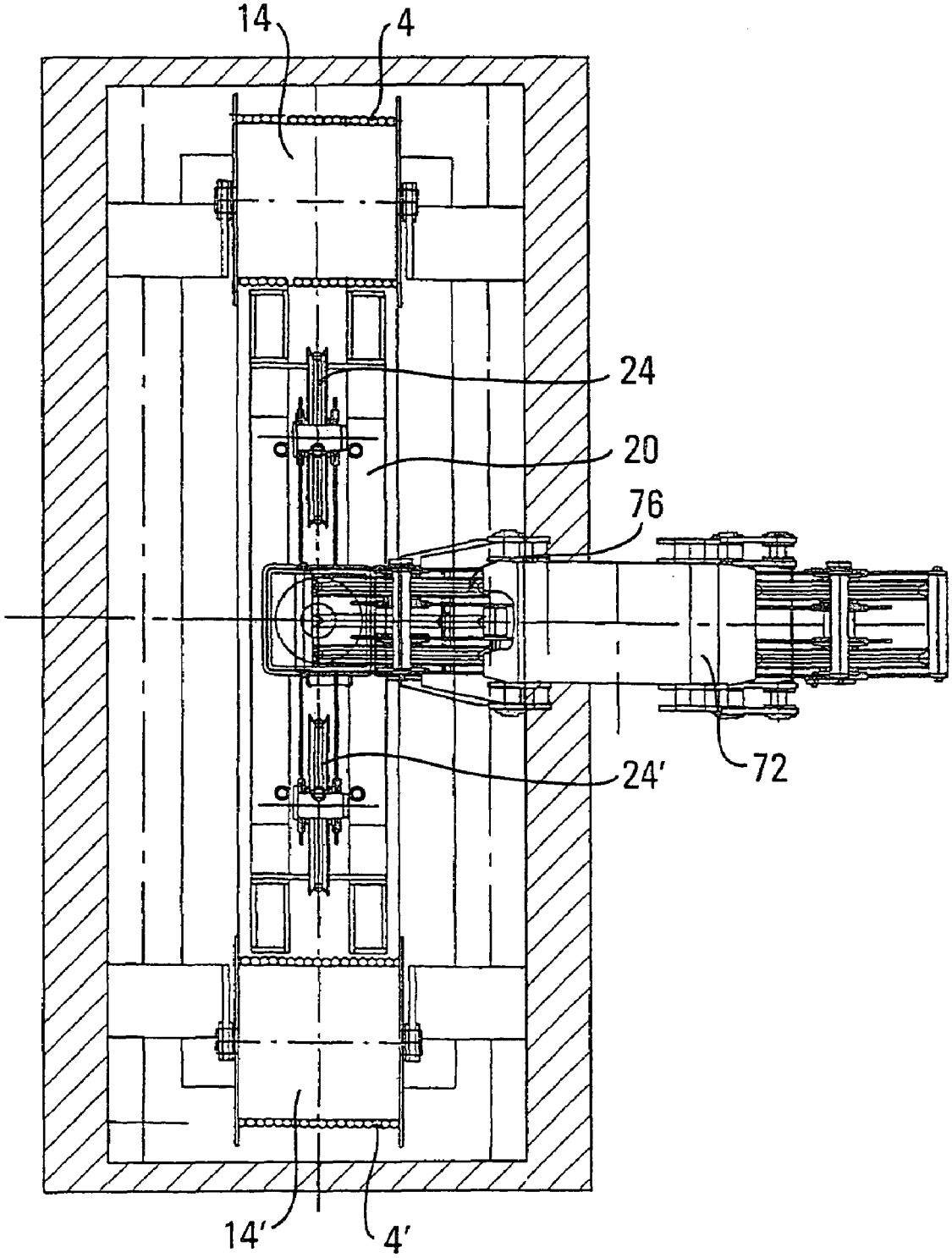
Figure 11:
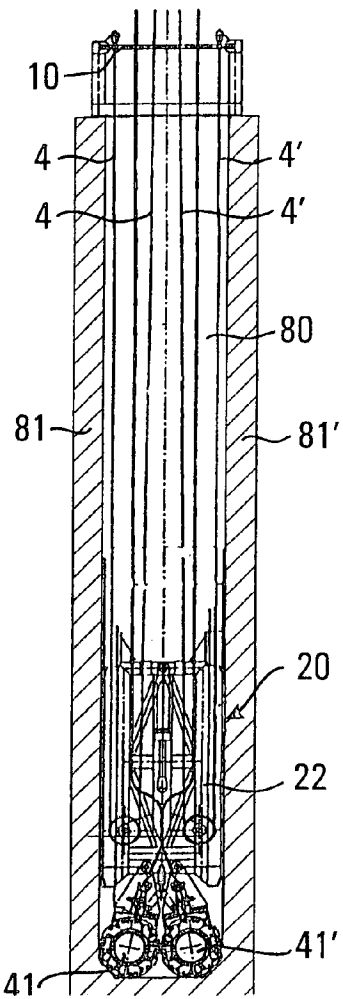
Figure 12:
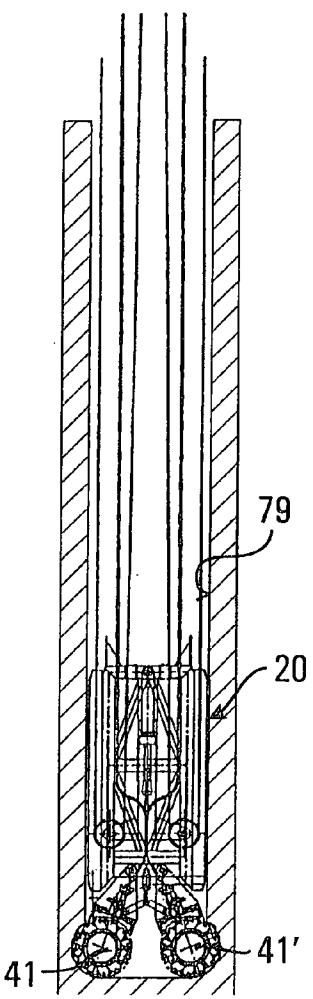

FIG. 10 A plan view of the apparatus of FIG. 6.

FIGS. 11 to 14 Different method stages in performing a soil working method.

Figure 15:
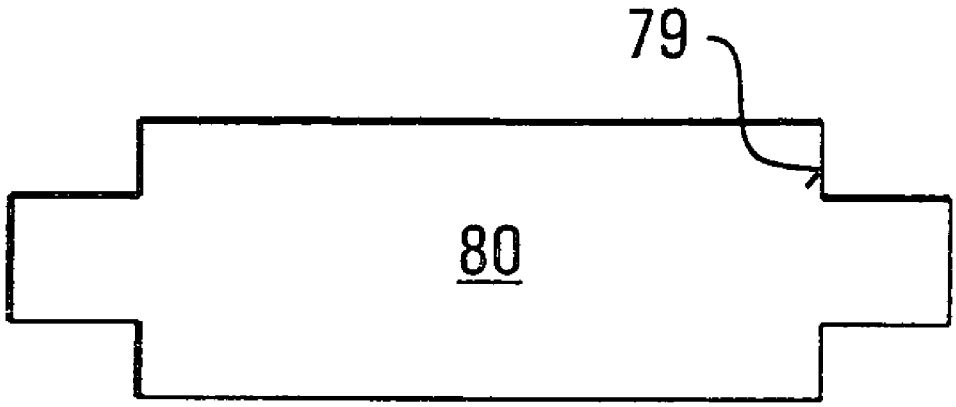
Figure 16:
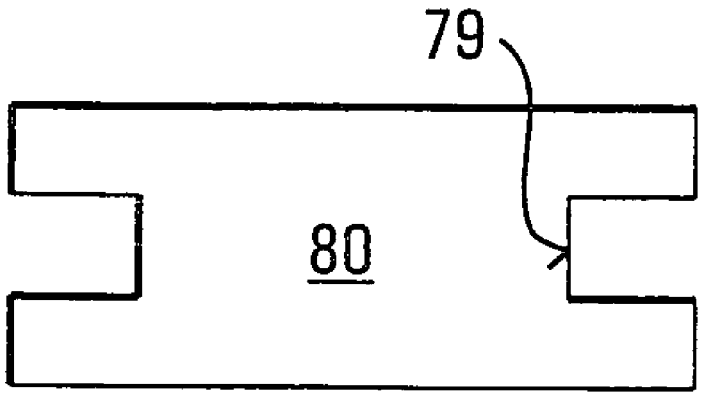

FIGS. 15 & 16 Cutting cross-sections of different soil working devices constructed as cutter.

Identically acting components are given the same reference numerals in all the drawings.

A first embodiment of a soil working apparatus is illustrated by FIGS. 1 to 5. The apparatus has a supporting device 70 on which is suspended a soil working device in the form of a cutter 20 by means of two supporting cables 4 4'. The supporting device has a crane jib 72, which is pivotably located on a construction truck 73. For the operation of the supporting cables 4, 4' the supporting truck carries a winch mechanism with two cable winches 74, 74', the cable winch 74' being shown merely in broken line form. From the cable winches 74, 74' the supporting cables 4, 4' are guided along the crane jib 72 to the return pulleys 76 located on the top of the crane jib 72. The supporting cables 4, 4' are led round the return pulleys 76 and from there run along the crane jib 72 to the cutter 20. On the winch mechanism the supporting cables 4, 4' are connected to the supporting device 70.

The cutter 20 has a cutting frame 22 on which are mounted in a lower area and at the same height, as well as with parallel rotation axes two return pulleys 24, 24'. The supporting cables 4, 4' running virtually vertically downwards from the return pulleys 76 of the supporting device 70 are led around said return pulleys 24, 24'. Following onto the return pulleys 24, 24' of the cutting frame 22, the supporting cables 4, 4' return upwards again to a holding frame 10 to which they are terminally fixed. For this purpose the supporting cables 4, 4' are provided at the ends with loops 54, which are hung in bolts 55 in an upper area of the holding frame 10.

As can be gathered from FIGS. 1 and 2, the holding frame 10 is carried along and raised by the cutting frame 22 of cutter 20 when the latter is raised from the ground. For this purpose the cutter 20 has in the lower area of the cutting frame 22 a driving device with stops corresponding to stops on the holding frame 10. However, if the cutter 20 is lowered into a trench 80 in the ground, in the manner shown in FIG. 3 the holding frame 10 rests on the soil surface and remains on the ground in the vicinity of the upper edge of the trench 80 on sinking the cutter 20. As the supporting cables 4, 4' are fixed both to the supporting device 70 and to the holding frame 10, roughly half the tensile force of cutter 20 is absorbed by the holding frame 10, as soon as the holding frame 10 stands on the ground. As a result there is a reduction to the tension in supporting cables 4, 4' and the loading of the supporting device 70, particularly the cable winches 74, 74', on sinking and raising the cutter 20.

The holding frame 10 has a cage-like construction and is centrally provided with a passage opening 11 for receiving the cutting frame 22. Both the cutting frame 20 and passage opening 11 have a rectangular cross-section. The holding frame 10 has individual grid struts 58, which embrace the cutter 20 in the extracted state. In addition, on the top side of the holding frame 10 there are two projections 59 on which are located bolts 55 for fixing the supporting cable 4, 4'. To prevent friction on the walls of trench 80 by the supporting cables 4, 4' guided through the passage opening 11, the projections 59 with bolts 55 project into the cross-section of trench 80.

The cutting frame 22 has an inverted U-shaped outer frame 36, whose arms are supported via horizontally directed struts 38, 39 and sloping struts 37. On the bottom on the sloping struts 37, the cutting frame 22 has a horizontally directed support 25 on which are terminally mounted the two return pulleys 24, 24'. On the outside of the arms of outer frame 36 and on the front of the cutting frame 22 are provided flat guide elements 34, which run vertically along the cutting frame 22 and support the latter on the walls of the trench 80.

The cutter 20 has two cutting wheels 41, 41', which are mounted in rotary manner about parallel rotation axes 43, 43'. The cutting wheels 41, 41' are constructed as cutting wheel pairs and in each case have two individual cutting wheels 48, 49. The individual cutting wheels 48, 49 of the cutting wheel 41' are mounted on a bearing bracket 46' located between the individual cutting wheels 48, 49. Analogously the individual cutting wheels of cutting wheel 41 are located on a bearing bracket 46. For the rotary driving of the cutting wheels 41, 41', in each case one hydraulic drive 47 is provided on the bearing brackets 46, 46'. By means of said hydraulic drives 47, the cutting wheels 41, 41' are rotated preferably in opposite rotation directions D, D' and the left-hand cutting wheel 41 in front view is rotated clockwise and the right-hand cutting wheel 41' in front view counter-clockwise. However, the reverse rotation direction is also possible.

The bearing brackets 46, 46' are pivotably mounted on the lower, horizontally directed strut 39 of cutting frame 22. The pivoting axes of the two bearing brackets 46, 46' are at least approximately parallel to one another. The pivoting axes are also at least approximately parallel to the rotation axes 43, 43' of cutting wheels 41, 41' and to the rotation axes of return pulleys 24, 24'. By means of an adjusting device the bearing brackets 46, 46' with the cutting wheels 41, 41' on cutter 20 can be pivoted, i.e. spread, so that the cutting cross-section of cutting wheels 41, 41' is variable. In particular, the cutting wheels 41, 41' can be spread in such a way that they project over the guide elements 34 of cutting frame 22 and consequently on raising the cutter work the walls of the trench 80 engaging on the guide elements 34.

The adjusting device has a toggle lever mechanism with two identically long levers 28, 28'. One end of the lever 28 is pivotably mounted on the bearing bracket 46, the pivoting axis of said bearing being at least approximately parallel to the pivoting axis of the bearing bracket 46 on cutting frame 22. In the same way one end of the lever 28' is mounted on the bearing bracket 46'. The in each case other end of the levers 28, 28' are interconnected in a joint 29. The axis of said joint 29 is at least approximately parallel to the pivoting axes of the bearing brackets 46, 46' on cutting frame 22.

The adjusting device also has a vertically directed hydraulic cylinder 26, which on its one side is mounted on the strut 39 of cutting frame 22 and on its other side on joint 29. If said hydraulic cylinder 26 is operated and extended, then joint 29 is moved downwards and the bearing brackets 46, 46' are spread or expanded by levers 28, 28'.

The cutter 20 and holding frame 10 are constructed in a substantially mirror symmetrical manner to a vertically directed plane of symmetry 31, running perpendicular to the drawing plane in FIG. 1. For supplying the hydraulic drives 47, hydraulic cylinder 26 and optionally further hydraulic operating means located on cutter 20, the apparatus for working the soil has supply lines 77 running from the top of the crane jib 72 to the cutter 20.

Another embodiment of a soil working apparatus is illustrated in FIGS. 6 to 10. The embodiment shown therein differs from the embodiment of FIGS. 1 to 5 in that the supporting cables 4, 4' are not fixed directly to the holding frame 10. On the contrary, the holding frame 10 of FIGS. 6 to 10 has on its top side a first cable drum 14 and a second cable drum 14' onto which is wound supporting cable 4 or 4' respectively. The rotation axes of cable drums 14, 14' are at least approximately parallel to the rotation axes of return pulleys 24, 24'. Each of the cable drums 14, 14' has a drive motor not shown in the drawings. The cable drums 14, 14' are particularly advantageous if it is necessary to use long lengths of supporting cables 4, 4' during working in considerable trench depths.

In addition, the soil working apparatus of the embodiment shown in FIGS. 6 to 10 differs from that embodiment described hereinbefore in that on the cutting frame 22 is provided a hydraulic feed cylinder 23 with which the two return pulleys 24, 24' for the supporting cables 4, 4' are vertically displaceable on the cutting frame 22. By operating said hydraulic feed cylinder 23 the vertical position of the return pulleys 24, 24' on cutter 20 can be modified and consequently the cutting depth of the cutting wheels 41, 41' can be varied, even in the case of fixed supporting cables 4, 4'.

For the displacement of the return pulleys 24, 24', on the hydraulic feed cylinder 23 is terminally provided a triangular-like support 63 on which the return pulleys 24, 24' are mounted. For protecting the hydraulic feed cylinder 23 the latter is surrounded by two telescopable sleeves 64, whereof one is fitted to the triangular-like support 63 and the other to the cutting frame 22.

Individual steps of a soil working method are illustrated in FIGS. 11 to 14. In the first method step illustrated in FIG. 11, the cutter 20 is introduced into a trench 80 located between two hardened trench wall primary panels 81, 81'. The actual trench 80 can be produced by the operation of the cutter 20 or by another trench wall mean. On introducing the cutter 20 into the trench 80, the holding frame 10 is left on the ground surface at the upper edge of trench 80. The supporting cables 4, 4' are in each case reeved in twin-lines on cutter 20 and one end of each is mounted at the holding frame 10, so that said holding frame 10 absorbs half the tensile force of cutter 20. In order not to overburden representation, the holding frame 10 is not shown in FIGS. 12 to 14.

On lowering the cutter 20 into the trench 80, the cutting wheels 41, 41' are in a retracted state. In said retracted state the cutting cross-section of the cutting wheels 41, 41' is inside the cross-section of trench 80 and cutting frame 22. Thus, on lowering the cutter 20 there is no removal of materials from the walls of the trench 80 through cutting wheels 41, 41'.

After the cutter 20 has been lowered onto the bottom of trench 80, the cutting wheels 41, 41' are rotated and through the operation of the adjusting device with the toggle lever mechanism are spread in opposition. As a result the cutting wheels 41, 41' enter into the two end walls 79 of trench 80. This state is cable drum shown in FIG. 12.

Figure 13:
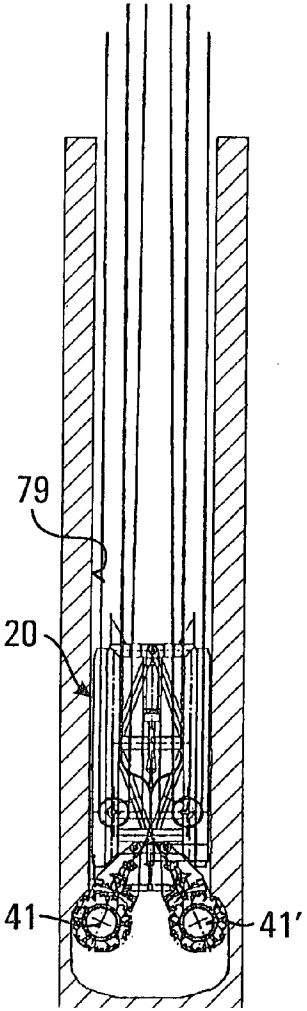

As is shown in FIG. 13, the cutter 20 is now raised and so the end walls 79 of trench 80 are cut from bottom to top. The comparatively high tensile forces of cutter 20 occurring on raising with spread cutting wheels 41, 41' are partly absorbed by the holding frame 10. In order to produce a particularly fluid-tight trench wall, the cutting wheels 41, 41' cut partially the primary panels 81, 81'.

The soil material produced during cutting drops by gravity below the cutter 20 onto the bottom of trench 80. It can be subsequently recovered from there using a grab. In this case the worked off soil material does not have to be sucked or pumped off. Thus, the cutter 20 is constructed without a pump mechanism for worked off soil material.

Figure 14:
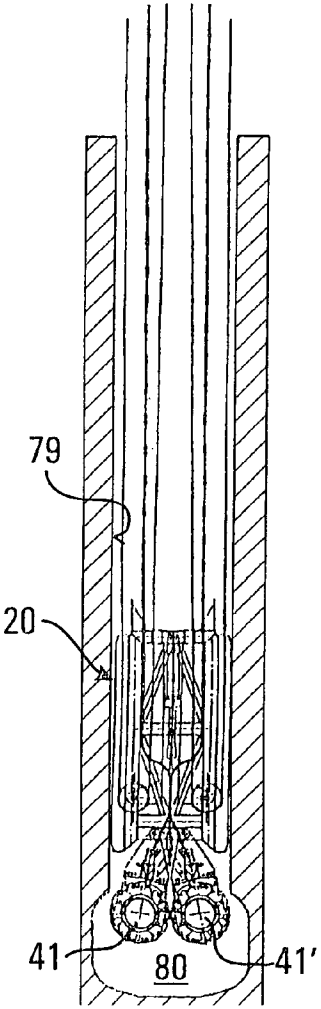

If an overcutting of the end walls of the trench 80 is required only over part of its total depth, in the manner shown in FIG. 14 the cutting wheels 41, 41' can be brought together again in slot 80 and the cutter 20 can then be raised without any action onto the walls of the trench 80.

FIGS. 15 and 16 show different cutting cross-sections, which can be obtained in a soil working method. For producing particularly liquid-tight trench walls, it can in particular be provided that the end walls 74 of trench 80 are only cut over part of their total width and this is in particular profiled. For this purpose preferably cutting wheels 41, 41' are provided which have a width smaller than the width of the end walls 79.

The invention claimed is:

1. A cutter for working the soil, comprising a cutting frame, at least two cutting wheels, which are supported on the cutting frame in a rotatably drivable manner about parallel axes of rotation, adjusting means for adjusting the centre distance between the parallel axes of rotation of the cutting wheels for changing a cutting cross-section of the cutter, wherein the adjusting means has a knee-lever mechanism and at least one hydraulic cylinder for operating the knee-lever mechanism, the hydraulic cylinder being arranged on the cutting frame approximately in the centre with respect to the two axes of rotation, at least one guide pulley for suspension in a supporting cable, and a feeding device through which the guide pulley can be displaced with respect to the cutting frame in the advance direction of the cutter, the feeding device including a hydraulic feed cylinder arranged centrally on the cutting frame.

2. The cutter according to claim 1, wherein the two cutting wheels are each supported on a bearing shield, the two bearing shields are pivotally supported on the cutting frame, and the knee-lever mechanism has two levers which are hinged on one side to a central hydraulic cylinder and on the other side to one of the two bearing shields respectively.

3. The cutter according to claim 1, wherein the cutting frame has guide members for guidance in a trench in the soil.

4. The cutter according to claim 3, wherein the cutting wheels can be adjusted by means of the adjusting means in such a way that in a retracted state they are set backwards with respect to the guide members and in an extended state they protrude laterally with respect to the guide members.

5. The cutter according to claim 2, wherein the bearing shields comprise a V-arrangement in the retracted state and the extended state, and in the retracted state the pivotal axes of the bearing shields at the cutting frame have a distance to each other being smaller than the distance between the axes of rotation of the cutting wheels.

6. The cutter according to claim 1, wherein a support device is provided, on which the supporting cable is suspended, a retaining frame is provided in addition to the support device and the supporting cable is connected to the retaining frame such that at least during the drawing of the cutter a part of the tensile force is directed via the retaining frame into the soil.

7. The cutter according to claim 1, wherein the cutting wheels are designed as cutting wheel pairs having two single cutting wheels each that are arranged in particular on both sides of a respective bearing shield.

8. The cutter according to claim 1, wherein the cutting frame, the cutting wheels and the knee-lever mechanism are designed in a mirror-symmetrical manner.

9. A method for working the soil, using the cutter according to claim 1, comprising the steps of:

introducing the cutter into a trench in the soil, enlarging the centre distance between the parallel axes of rotation by means of the knee-lever mechanism such that the two cutting wheels protrude laterally from the cutting frame, and setting the cutting wheels into rotation and drawing in the cutter while material is being stripped on the walls of the trench.

* * * * *